United States Patent [19]

Compte

[11] 4,236,698

[45] Dec. 2, 1980

[54] RAILING FOR BUILDING WORKS AND THE LIKE

[75] Inventor: Jean Compte, Samois sur Seine, France

[73] Assignee: Campenon-Bernard Cetra, Clichy, France

[21] Appl. No.: 25,637

[22] Filed: Mar. 30, 1979

[30] Foreign Application Priority Data

Mar. 31, 1978 [FR] France ..... 78 09620

[51] Int. Cl.[2] ..... E04H 17/16

[52] U.S. Cl. ..... 256/23; 256/DIG. 6; 182/113

[58] Field of Search ..... 256/DIG. 6, 65, 59, 256/24, 23; 182/113; 248/227; 52/DIG. 12, 297, 298

[56] References Cited

U.S. PATENT DOCUMENTS

| | | | |
|---|---|---|---|
| 12,385 | 8/1855 | Bruley | 52/298 |
| 194,724 | 8/1877 | Reed | 256/65 |
| 1,297,838 | 3/1919 | Haines | 52/298 |
| 2,332,477 | 10/1943 | Thornley | 182/113 |
| 3,920,221 | 11/1975 | Berry | 256/59 |
| 4,045,003 | 8/1977 | McCluskey | 256/59 |

FOREIGN PATENT DOCUMENTS

| | | | |
|---|---|---|---|
| 1306476 | 9/1962 | France | 182/113 |
| 1479408 | 3/1967 | France | 256/65 |

*Primary Examiner*—Andrew V. Kundrat
*Attorney, Agent, or Firm*—Neil F. Markva

[57] ABSTRACT

The invention relates to a parapet or railing assembly for building works and the like. The railing assembly comprises a hand rail and an intermediate rail connected together by cross bars to form a rigid railing frame. Posts include hooks for hanging the railing frame to the posts. The cross-bars are secured at the ends of the rails to constitute the rigid railing frame with the rails. The inner width of the hooks formed between the free end portions and the pole is greater than twice the width of the rails, whereby two overlapping frames can be hanged to a same post, even if the posts are not aligned.

4 Claims, 3 Drawing Figures

RAILING FOR BUILDING WORKS AND THE LIKE

BACKGROUND OF INVENTION

This invention relates to parapets or railing assemblies, more particularly for use on building works to prevent workers falling from the floors or platforms of said works.

Usually, such railing assemblies comprise a handrail, an intermediate rail and often a plinth element, which are secured to vertical supports such as posts and include upwardly directed hooks in which the rails are hanged.

SUMMARY OF INVENTION

It is an object of the invention to provide a railing or parapet for works which is simple to manufacture and to be put into place.

It is another object of the invention to provide a railing which is reliable and which can be easily assembled, even if the post is not aligned.

According to the invention, the railing assembly comprises posts and a railing frame. The railing frame includes a hand rail and an intermediate rail connected together by cross-bars secured at the ends of the rails to form a rigid frame structure. The posts include a pole and two hooks which are laterally spaced along the pole and are effective to hang the railing frame to the posts. The hooks have upwardly directed free end portions which are spaced outwardly from the pole to form an inner width that is larger than twice the width of said rails whereby two overlapping frames can be hanged to each post even if the various posts are not exactly aligned.

In another feature of the invention, the posts include a hook having downwardly directed free end portion which terminates short of the lower end of the pole. The downwardly directed hooks can be used for securing plinth elements along the ground and they allow an adjustment of the penetration of the poles in the ground by abutting against the ground.

BRIEF DESCRIPTION OF DRAWINGS

Other objects of this invention will appear in the following description and appended claims, reference being made to the accompanying drawings forming a part of the specification wherein like reference characters designate corresponding parts in the several views.

DETAILED DESCRIPTION

Figure 1:
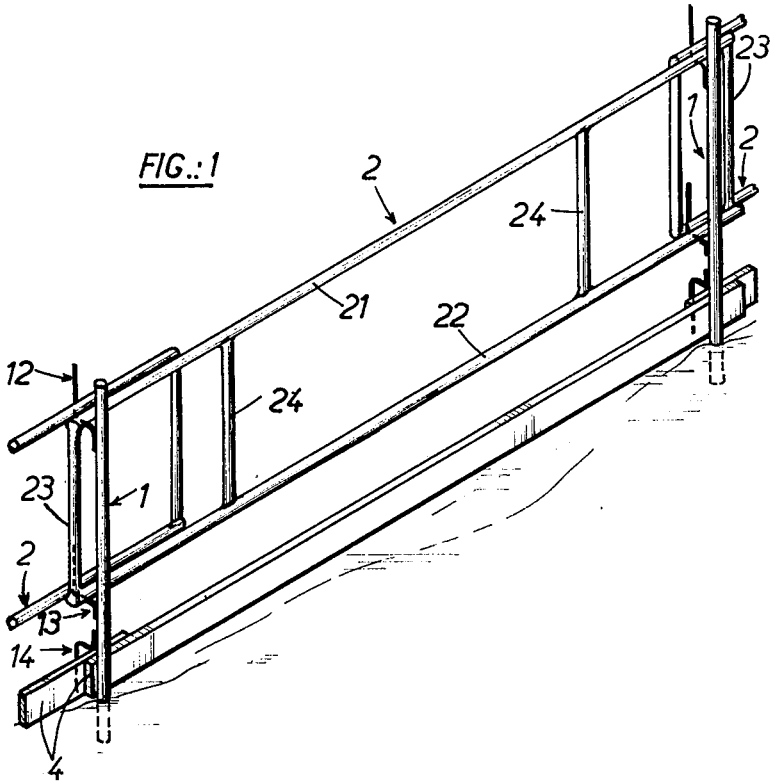
FIG. 1 is a perspective view of a part of a railing or parapet according to the invention.

Referring to the drawings, the railing comprises posts 1, railing frames 2, mounting sleeves 3 and plinth elements 4.

The posts 1 comprise a pole 11 made, for instance, out of a piece of metal tube having a length of about 1.20 meter and including three hooks 12, 13 and 14 welded to the outside surface thereof.

Hooks 12 and 13 have a connected bottom portion and an upwardly directed free end portion. The upper hook 12 is located near the upper end 17 of the pole, for instance, a few centimeters below end 17, and hook 13 is located about at the midst of the pole.

The lower hook 14 has a downwardly directed free end portion and is located adjacent lower end 15 of pole 11. The free end of hook 14 terminates short of end 15, so that pole 11 extends below the free end of the hook 14 an amount sufficient to allow post 1 to be firmly secured in the ground.

End 15 of post 1 sets in a sleeve 3 having a suitable inner cross-section and a length of about 15 centimeters. In this embodiment, sleeve 3 is embedded in the ground and can be stopped after the railing has been removed.

Figure 2:
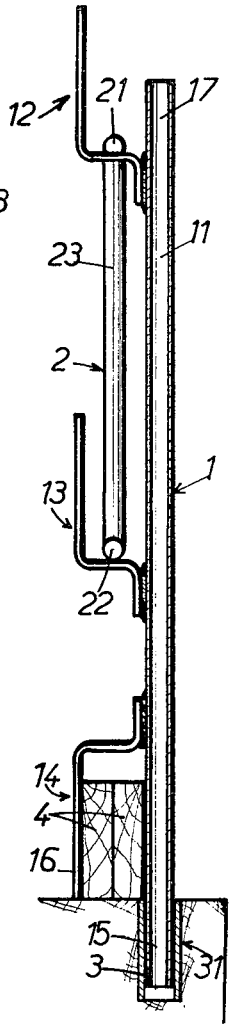
FIG. 2 is a vertical section of the railing through a post.
Figure 3:
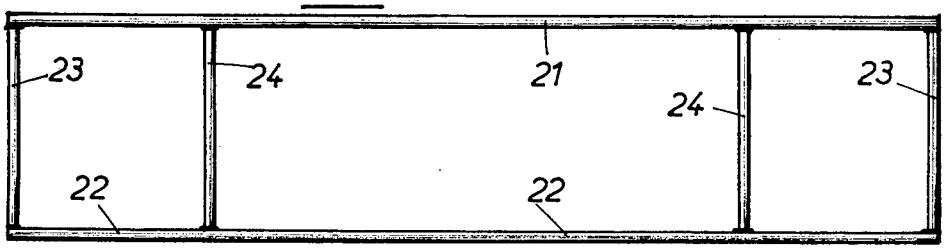
FIG. 3 is an elevation view of a reinforced rectangular frame.

The poles 11 and the sleeves 3 can be made out of matching steel tubes. Hooks 12, 13 and 14 can be made out of the usual concrete steel bars. They can be about 20 cm length, 8–10 centimeters width and have a short tail or connected portion to be welded to the post. Preferably, upper hook 12 extends beyond upper end 17 of the post 1 as shown in FIG. 2 to prevent railing frame 2 from being accidentally unhooked.

The particular disposition of lowest hook 14 limits the penetration of post 1 into sleeve 3 and secures plinth elements 4, e.g. wooden boards, which are inserted between the free end portion of hooks 14 and pole 11 and set edgewise on the ground or floor. Such plinth elements 4 prevent objects such as stones, bolts from falling out of the floor.

In this embodiment, post 1 is made out of a 26/34 mm steel tube and has a length of 1.20 m. The three steel hooks 12, 13 and 14 have a width of 12 mm and a length of 20 cm. Post 1 weighs 3–6 kg and is easy to handle.

Railing frames 2 are also conveniently made out of steel tubes. They have a rectangular shape and are made of two longitudinal rails 21, 22 connected by end cross-bars 23 and intermediate cross-bars 24. In this embodiment, frame 2 has rails of 2.4 m and a height 30 of 0.58 m with two intermediate cross-bars located at about 50 cm of the ends. Frame 2 is made out of a 27/30 mm steel tube and weighs 7.8 kg and can be easily handled by one man.

For mounting the railing, it is sufficient to set the posts 1 into the corresponding sleeves 3 and to hang the hand rails 21 into hooks 12 and the intermediate rails 22 into hooks 13.

The inner width of hooks 12 and 13 is slightly larger than the width of the rails. Consequently, two overlapping frames may be secured on the same post even if the posts are not exactly aligned. The distance along post 1 between the bases of the hooks 12 and 13 fixed to post 1 is equal to the distance between the hand rail 21 and the intermediate rail 22 of frame 2.

Preferably, posts 1 are separated by spaces slightly smaller than the length of frames 2 but they could be set closer from one another if necessary.

Disassembling of the railing is easy, as well as transportation and storage of its elements. This facilitates re-use of the railing.

I claim:

1. A railing assembly for building works and the like comprising:

(a) posts and a railing frame, (b) said railing frame including a hand rail and an intermediate rail connected together by cross-bars, (c) said cross-bars being secured at the ends of said rails to form a rigid structure, (d) said posts including a pole and two hooks which are laterally spaced along the pole and are effective to hang said railing frame to said posts, (e) said hooks having upwardly directed free end portions which are spaced outwardly from the pole to form an inner width that is larger than twice the width of said rails whereby two overlapping railing frames can be hanged to each post even if said posts are out of line.

2. A railing assembly according to claim 1 wherein said posts include a hook fixed to said pole and having a free end portion downwardly directed for securing plinth elements along the ground, said free end portion terminates short of the lower end of said pole whereby the penetration of the posts in the ground can be limited by contact of the free end of said hook with the ground.

3. A railing assembly according to claim 1 wherein sleeves are adapted to be secured in the ground for setting the lower end of each said pole in the sleeves.

4. A railing according to claim 1, wherein the hand rail and the intermediate rail are parallel with respect to each other to form a rigid rectangular railing frame.

* * * * *